US009061812B1

(12) United States Patent
Loritz

(10) Patent No.: US 9,061,812 B1
(45) Date of Patent: Jun. 23, 2015

(54) TAMPER-EVIDENT LOCKING CONTAINER

(71) Applicant: Ken Loritz, Irvine, CA (US)

(72) Inventor: Ken Loritz, Irvine, CA (US)

( * ) Notice: Subject to any disclaimer, the term of this patent is extended or adjusted under 35 U.S.C. 154(b) by 0 days.

(21) Appl. No.: 13/906,337

(22) Filed: May 30, 2013

Related U.S. Application Data

(60) Provisional application No. 61/653,404, filed on May 30, 2012.

(51) Int. Cl.
*B65D 85/00* (2006.01)

(52) U.S. Cl.
CPC ..... *B65D 85/00* (2013.01)

(58) Field of Classification Search
CPC .... B65D 43/162; B65D 43/169; B65D 55/02; B65D 85/00; B65D 2101/00
USPC ..... 206/459.1, 459.5, 807; 220/833–839; 40/311, 312
See application file for complete search history.

(56) References Cited

U.S. PATENT DOCUMENTS

| | | | | |
|---|---|---|---|---|
| 1,977,302 | A * | 10/1934 | Brill | 220/833 |
| 2,013,299 | A * | 9/1935 | Byrne | 206/807 |
| 3,698,551 | A * | 10/1972 | Tomlinson | 206/459.5 |
| 6,398,067 | B1 * | 6/2002 | Belfance et al. | 220/833 |
| 7,735,678 | B2 * | 6/2010 | Rushe et al. | 220/837 |

* cited by examiner

*Primary Examiner* — Bryon Gehman
(74) *Attorney, Agent, or Firm* — Kafantaris Law Office; Theo Kafantaris

(57) ABSTRACT

The present invention will provide tamper-evident container which can be displayed via a hang tag, which clearly shows whether or not the tamper-evident seal has been broken. Furthermore, the present invention uses a seal which is not connected between the cap and the container, but rather is displayed clearly above the cap. This is accomplished by a container having a rim and flange at the opening for use with an attachable and detachable cap hingedly mounted to the container, a flexible hang tag, and perforation means used in collaboration with a mounting plate and hang tag.

10 Claims, 5 Drawing Sheets

TAMPER-EVIDENT LOCKING CONTAINER

CROSS-REFERENCE TO RELATED APPLICATIONS

This application claims the benefit of U.S. Provisional Patent Application No. 61/653,404, filed on May 30, 2012, and incorporated herein by reference.

STATEMENT REGARDING FEDERALLY SPONSORED RESEARCH AND DEVELOPMENT

Not Applicable.

FIELD OF THE INVENTION

This invention relates to a tamper-evident container and retaining means, and more particularly, to a disposable apparatus comprising a container for holding liquids, gases, and/or solids, having an attached retaining means.

DISCUSSION OF RELATED ART

Tamper-evident containers are generally described as containers having a means for preventing or detecting unauthorized access to the contents of the container. A common tamper-evident container is molded from plastic and has a "screw-top" structure, which includes an upright threaded neck, an annular neck ring, and an internally threaded cap. Such containers are intended to hold solids or liquids for consumer consumption.

Several methods exist for providing tamper-evident or tamper-proof containers. One widely used method includes securing a seal over the mouth of the container beneath the cap. Other methods include vacuum sealing the contents and providing cap protrusions which remain depressed due to the vacuum contained within the container.

U.S. Pat. Nos. 4,586,622 and 4,449,640 describe an open-top vial covered by a cap having a depending peripheral skirt, such that an inner surface of the cap skirt and an outer surface of the cap are provided with complementary mating interlock elements. Moreover, the caps comprise an integral tear member, defined by at least one weakened, partially circumferential weakened junction line, such that pulling away the tear member along the junction line allows both removal of the cap and ready visual confirmation that vial integrity has been breached.

Other examples include containers having a flange about its opening such that, below the flange and spaced apart therefrom, a shoulder defines an indented neck therebetween. An overcap extends over the flange and about the neck to form a skirt about the neck. The skirt has at least a portion thereof extending inwardly in gripping reaction with the neck and limited in removal by contact with the underside of the flange, whereby the cap cannot be removed without destroying a structural integrity thereof. Although containers with improved closure have been proposed, they may usually be used only once.

The prior art provides numerous types of sealing devices which are intended to prevent tampering. While various types of tamper-evident containers exist in the prior art, they are limited in that they use the seal at the connection point between the cap and container, and are often difficult to open. Additionally, the prior art's devices do not clearly display the tamper-evident seals. Therefore, a need exists for a tamper-evident seal which is not connected between the cap and the container, and which clearly displays whether or not the seal has been broken. The present invention satisfies these needs.

SUMMARY OF THE INVENTION

The present invention will provide tamper-evident container which can be displayed via a hang tag, which clearly shows whether or not the tamper-evident seal has been broken. Furthermore, the present invention uses a seal which is not connected between the cap and the container, but rather is displayed clearly above the cap. This is accomplished by a container having a rim and flange at the opening for use with an attachable and detachable cap hingedly mounted to the container, a flexible hang tag, and perforation means used in collaboration with a mounting plate and hang tag.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
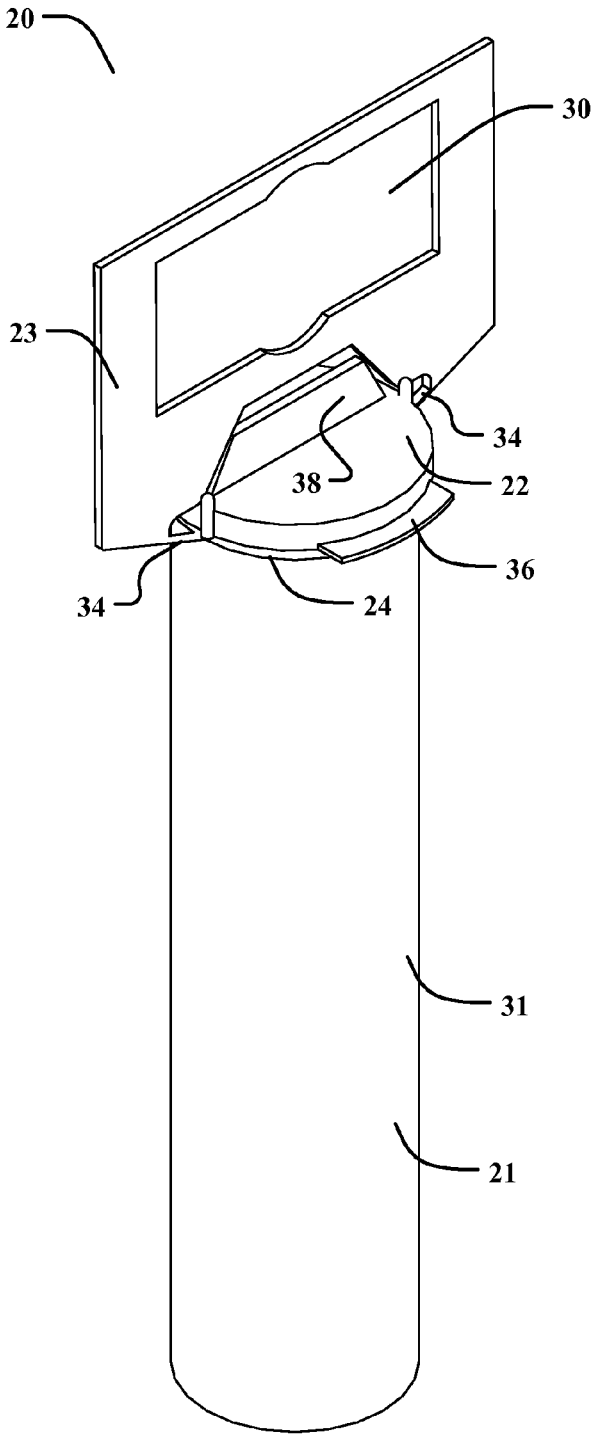
FIG. 1 is a perspective view of the invention in the locked position.
Figure 2:
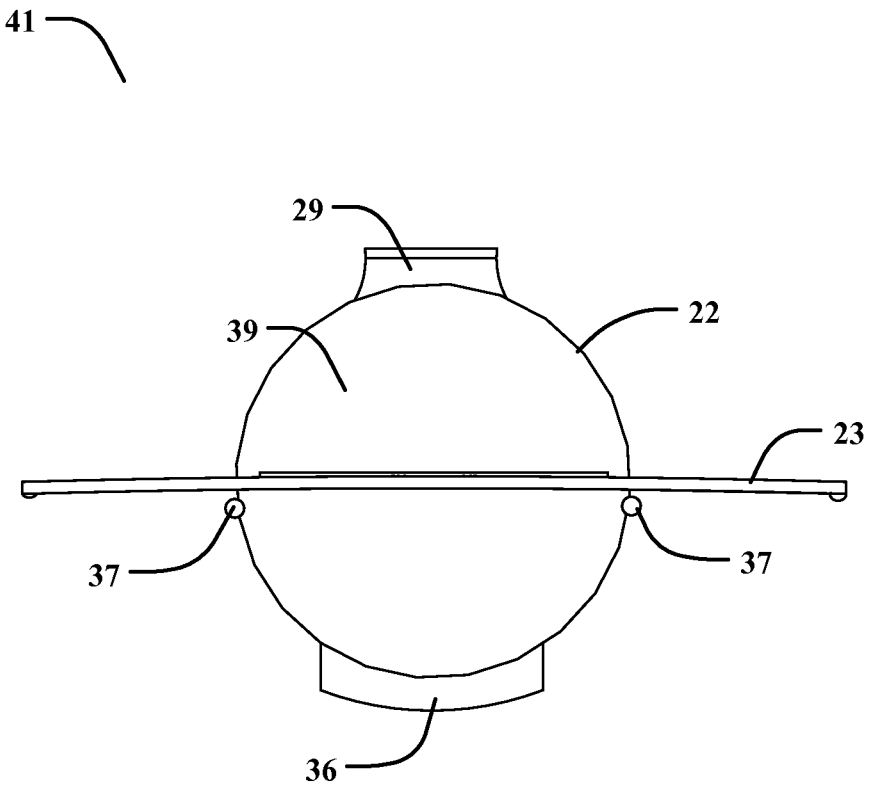
FIG. 2 is a top plan view of the invention in the locked position.
Figure 3:
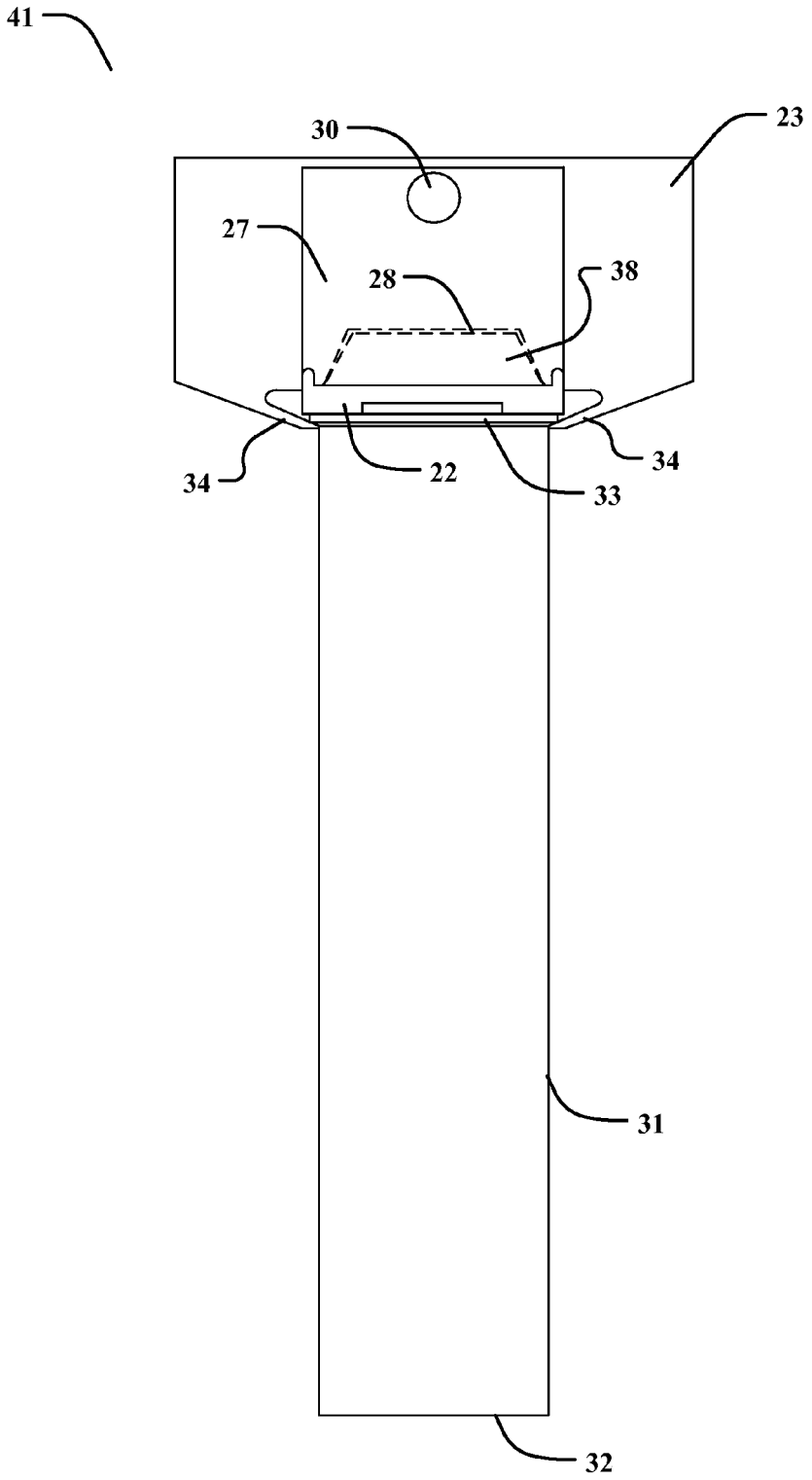
FIG. 3 is a front elevational view of the invention in the locked position.
Figure 4:
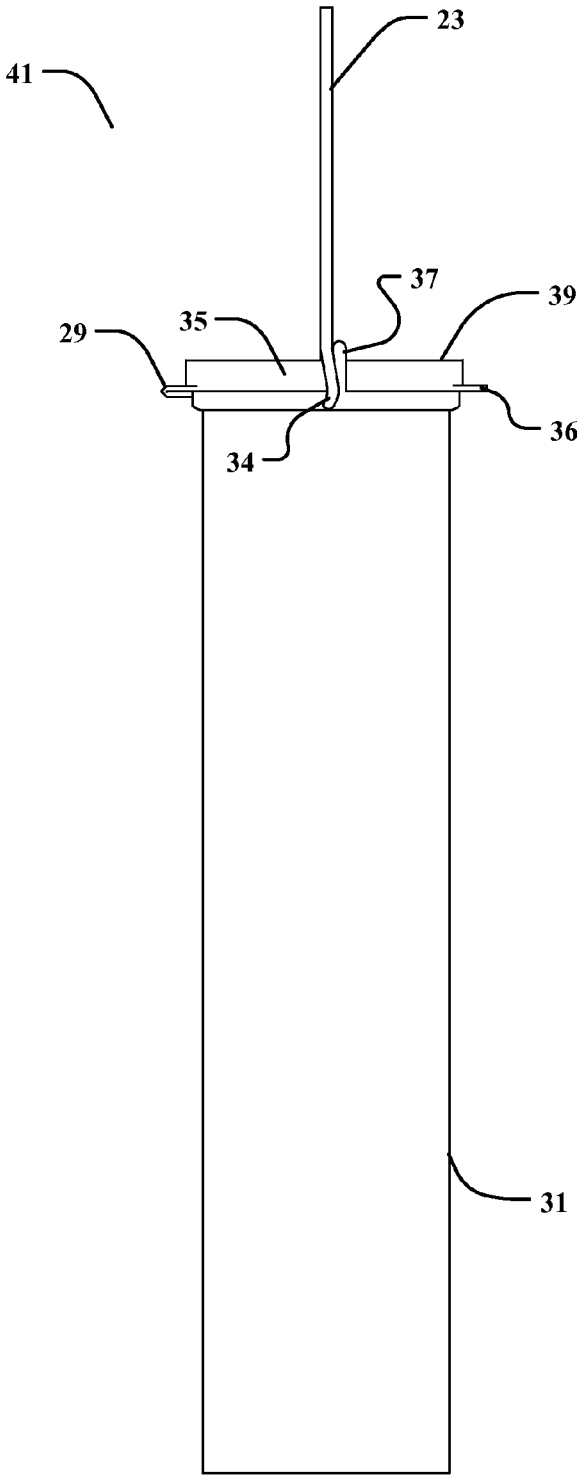
FIG. 4 is a side elevational view of the invention in the locked position.
Figure 5:
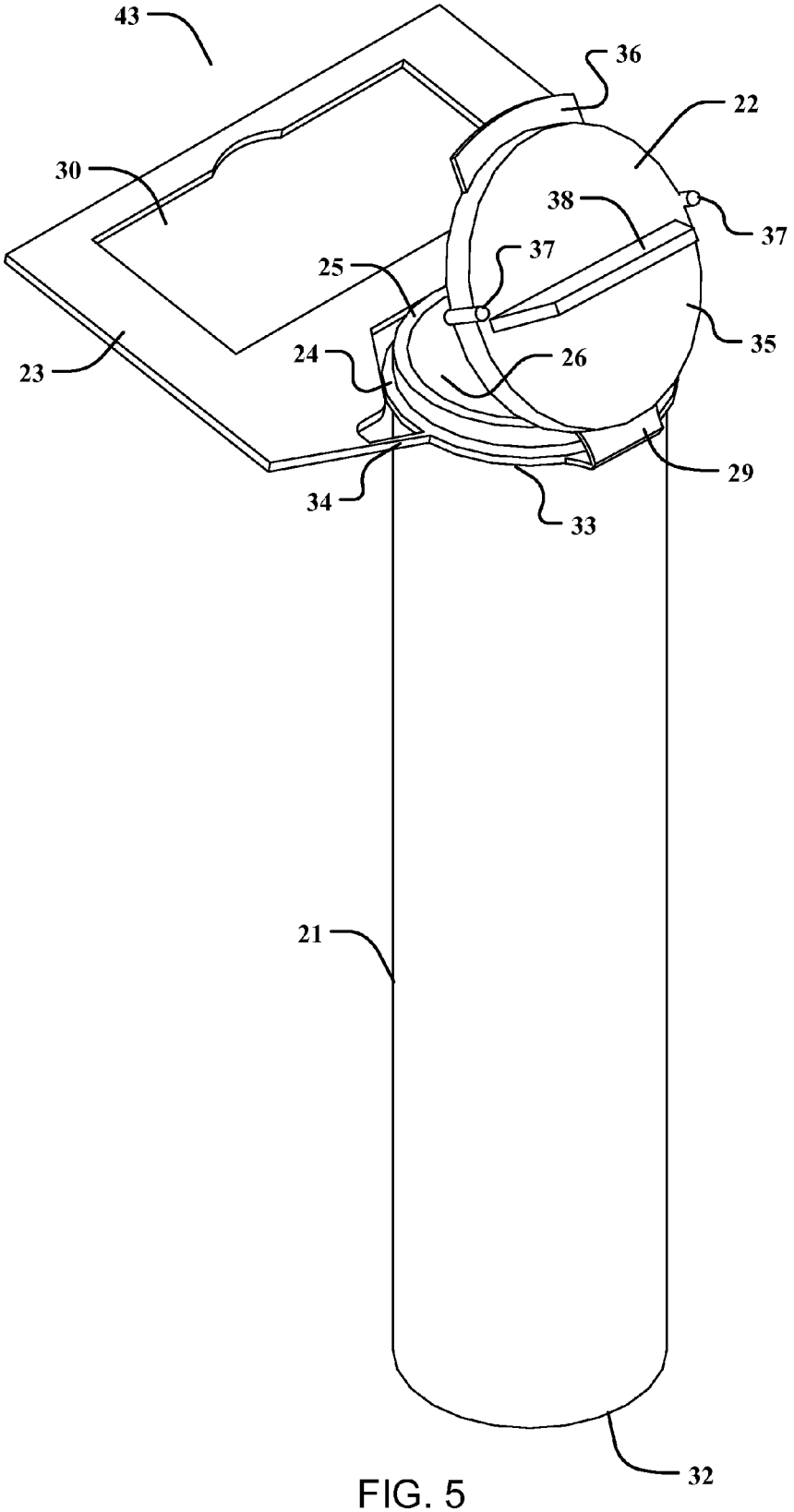
FIG. 5 is a perspective view of the invention in the unlocked position.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention comprises a container 20 for holding liquids, gases, and/or solids, further comprising a container body 21, cap 22, and mounting plate 23. The container body 21 comprises a rim 24 and flange 25 at the opening 26 for use with the attachable and detachable cap 22 hingedly mounted to the container 20. The mounting plate 23 is attached to the rim 24 of the container 20 and provides a means for locking and unlocking the cap 22 from the container body 21. The mounting plate 23 may further include a packing sticker or label 27 having a perforated section or seal 28 for providing evidence of use or abuse.

The container body 21 comprises an elongated hollow cylinder 31 having a closed end 32 and an open end 33. The rim 24 and flange 25 are positioned at the open end 33 of the container body 21 and provide for an air-tight seal when the cap 22 is attached. Opposing mounting plate arms 34 are positioned below the flange 25 on the rim 24 and extend outward horizontally. The open end 33 of the container body 21 and flange 25 fit deeply into a recessed portion 35 of the cap 22, resulting in not only a tighter seal, but also making it impossible to lift the cap 22 to break the seal without tearing the perforated section 28. After opening the container 20 and breaking the seal 28, the dimensions of the rim 24 and flange 25 allow for easy reuse, as the cap 22 is designed to fit snuggly thereon.

The cap 22 is attached to the container 20 with a hinge 29 between the cap 22 and the rim 24. Opposite the hinge 29, a horizontal flat protrusion 36 is provided for easily removing the cap 22 from the container body 21 and permitting easy recapping if reuse is desired. Locking extensions 37 are positioned on the cap 22 near the mounting plate arms 34 and are generally offset from center, supplementary to the mounting plate arms 34. The locking extensions 37 operate to obstruct the path of the mounting plate 23 or mounting plate arms 34. The cap 22 also provides a flat vertical protrusion 38 extending from its top 39 and is positioned between the locking extensions 37, generally perpendicular to a line between the hinge 29 and horizontal flat protrusion 36.

The flexible mounting plate 23 or hang tag allow for the container 20 to be hung in a display manner, such as in a store display, through an aperture 30. The mounting plate 23 is attached between the mounting plate arms 34 and is positioned such that the mounting plate 23 and flat vertical protrusion 38 are adjacent in the locked position 41. As such, the mounting plate 23 directly obstructs the cap 22 from being removed, effectively locking the container 20 and protecting the contents from unauthorized use. Furthermore, the locking extensions 37 prevent the perforation section 28 from breaking inadvertently. To convert the container 20 to an unlocked position 42, the mounting plate arms 43 must be forcefully pushed past the locking extensions 37, un-obstructing the cap 22 and flat vertical protrusion 38.

A mounting sticker or label 27 may be placed over both the mounting plate 23 and flat vertical protrusion 38, with a perforated section 28 generally positioned between each object 23, 38, respectively. As such, the flat vertical protrusion 38, mounting plate 23, and perforated section 28 provide the tamper-evident sealing mechanism 43 when used in combination therebetween. Furthermore, the mounting plate 23 is retained by the mounting plate arms 34, removing all load-bearing force from the perforated seal 28 and preventing it from breaking inadvertently. Lastly, the mounting plate arms 34 extend outward toward the locking extensions 37, providing the unlocked position 42 as the natural position for the container 20. As such, when in the locked position 41, the mounting plate 23 is constantly pressed against the locking extensions 37, positioning the mounting plate 23 in a position to obscure the opening of the cap 22.

While the mounting plate 23 is intended to remain fixed to the container body 21, it is within the purview of the present invention that it be removed for reuse. In this instance, the mounting plate arms 34 will be severed from the container body 21, thus detaching the mounting plate 23 entirely. After removal, there will be no locking mechanism 43 or other means of protecting the contents of the container 20. As such, the contents can be accessed by simply lifting the cap 22 from the container body 21.

While the above description contains specific details regarding certain elements, sizes, and other teachings, it is understood that embodiments of the invention or any combination of them may be practiced without these specific details. Specifically, although certain shapes are designated in the above embodiments, any shape may be used (cylindrical, square, etc). These details should not be construed as limitations on the scope of any embodiment, but merely as exemplifications of the presently preferred embodiments. In other instances, well known structures, elements, and techniques have not been shown to clearly explain the details of the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A tamper-evident container comprising:

a container body having a closed end and an open end, said open end further comprising a flange;

a rim positioned at said open end of said container body, said rim further comprising a pair of opposing mounting plate arms;

a mounting plate attached to said pair of opposing mounting plate arms such that said mounting plate and said mounting plate arms may rotate about said open end along a path of rotation;

an attachable and detachable cap for providing an air tight seal when attached to said flange of said container body, said cap attached to said rim independent of said pair of opposing mounting plate arms through a hinge;

a pair of opposing locking extensions attached to said cap positioned for obstructing the path of rotation of said pair of opposing mounting plate arms; and a label further comprising a perforated section for providing evidence of use or abuse;

wherein said mounting plate is adapted to lock and unlock said container by obstructing or un-obstructing said cap.

2. The tamper-evident container of claim 1, wherein said cap further comprises a deeply recessed portion resulting in a tighter seal and preventing said cap from being removed without breaking said perforated section.

3. The tamper-evident container of claim 1, wherein said cap further comprises a horizontal flat protrusion opposite said hinge for easily removing said cap from said container body and for easy recapping.

4. The tamper-evident container of claim 3, wherein said cap further comprises a flat vertical protrusion extending from its top and positioned between said locking extensions, perpendicular to a line between said hinge and said horizontal flat portion.

5. The tamper-evident container of claim 4, further comprising a mounting sticker is positioned adjacent to said mounting plate and said flat vertical protrusion.

6. The tamper-evident container of claim 5, wherein said perforated section is positioned between said mounting plate and said flat vertical protrusion.

7. The tamper-evident container of claim 1, wherein said mounting plate further comprises an aperture for hanging said container in a store display.

8. The tamper-evident container of claim 1, wherein said container further comprises a locked position and an unlocked position;

said locked position comprising moving said pair of opposing mounting plate arms to a vertical position relative to said container body wherein said mounting plate is perpendicular to said locking extensions and said locking extensions are obstructing said pair of opposing mounting plate arms, preventing said cap from being opened; and said unlocked position comprising forcefully moving said pair of opposing mounting plate arms past said locking extensions such that said mounting plate no longer obstructs said cap, permitting said cap to be opened.

9. The tamper-evident container of claim 8, wherein said locking extensions are generally offset from center such that said mounting plate arms may stand vertically when obstructed from said locking extensions.

10. The tamper-evident container of claim 9, wherein the natural state of said mounting plate is in said open position, and wherein said mounting plate is constantly pressed against said locking extensions in said closed position.

* * * * *